US005893333A

United States Patent [19]

Smedal

[11] Patent Number: 5,893,333

[45] Date of Patent: Apr. 13, 1999

[54] LOADING/UNLOADING TERMINAL, ESPECIALLY FOR LOADING OR UNLOADING OF PETROLEUM PRODUCTS

[75] Inventor: Arne Smedal, Faervik, Norway

[73] Assignee: Den Norske Stats Oljeselskap A.S., Stavanger, Norway

[21] Appl. No.: 08/836,157

[22] PCT Filed: Nov. 3, 1995

[86] PCT No.: PCT/NO95/00203

§ 371 Date: Jul. 8, 1997

§ 102(e) Date: Jul. 8, 1997

[87] PCT Pub. No.: WO96/14238

PCT Pub. Date: May 17, 1996

[30] Foreign Application Priority Data

Nov. 4, 1994 [NO] Norway ..... 944212

[51] Int. Cl.[6] ..... B63B 21/00

[52] U.S. Cl. ..... 114/230; 441/4

[58] Field of Search ..... 114/293, 230; 441/3–5

[56] References Cited

U.S. PATENT DOCUMENTS

| | | | |
|---|---|---|---|
| Re. 32,578 | 1/1988 | Poldervaart et al. . | |
| 3,335,690 | 8/1967 | Busking | 114/230 |
| 3,407,768 | 10/1968 | Graham | 114/230 |
| 3,525,312 | 8/1970 | Beck | 441/5 |
| 3,568,621 | 3/1971 | Kawasaki | 114/248 |
| 3,834,432 | 9/1974 | Lilly, Jr. et al. | 441/4 |
| 3,973,512 | 8/1976 | Fahrner | 114/248 |
| 4,490,121 | 12/1984 | Coppens et al. . | |
| 5,044,297 | 9/1991 | de Baan et al. . | |
| 5,529,521 | 6/1996 | Breivik et al. | 441/5 |

FOREIGN PATENT DOCUMENTS

| | | | |
|---|---|---|---|
| 9311032 | 6/1993 | European Pat. Off. . | |
| 1214570 | 4/1966 | Germany . | |
| 2156179 | 5/1973 | Germany | 441/4 |
| 153092 | 1/1986 | Norway . | |
| 2163403 | 2/1986 | United Kingdom . | |

*Primary Examiner*—Ed L. Swinehart

*Attorney, Agent, or Firm*—Sughrue, Mion, Zinn, Macpeak & Seas, PLLC

[57] ABSTRACT

A loading/unloading terminal, especially for use in loading or unloading of petroleum products comprises a barge (1) provided with a downwardly open receiving space (2) for reception and releasable securement of a submerged buoy (20), and a submerged buoy (20) of the type comprising a bottom-anchored center member (21) for passage of medium from or to a transfer line (32) attached to the center member, and an outer member (23) rotatably mounted on the center member (21) to allow turning of the barge (1;40) about the center member (21) when the outer member (23) is secured in the receiving space (2) of the barge. The barge (1) further is provided with a coupling means (4) for connection of the passage (22) of the center member (21) to a line (9) for medium transfer to or from an adjacent conventional tanker, and with a means (10–14) for hoisting and introduction of the buoy (20) into the receiving space.

7 Claims, 4 Drawing Sheets

LOADING/UNLOADING TERMINAL, ESPECIALLY FOR LOADING OR UNLOADING OF PETROLEUM PRODUCTS

BACKGROUND OF THE INVENTION

This invention relates to a loading/unloading terminal, especially for use in loading or unloading of petroleum products.

In connection with offshore loading or unloading of hydrocarbons (oil and gas) there has been developed—during the recent years—a special technology called STL technology, wherein the abbreviation STL stands for "submerged turret loading". This technique is based on the use of a special buoy construction consisting of a submerged buoy which comprises a bottom-anchored centre member having a passage for transfer of a flowable medium from or to a transfer line attached to the centre member, and an outer member which is rotatably mounted on the centre member and is arranged for introduction and releasable securement in a submerged downwardly open receiving space at the bottom of a vessel. The outer member of the buoy constitutes a buoyancy member, and when the buoy is not in use it floats submerged at a chosen distance below the sea level, the buoyancy of the buoy corresponding to the weight of the anchoring system of the buoy. In use, the buoy is hoisted up by means of a pick-up line attached to the buoy, and the outer member of the buoy is secured in the receiving space in the topical tanker, for instance a so-called shuttle tanker. The buoy structure allows the vessel during loading/unloading operations to turn about the bottom-anchored centre member of the buoy, under the influence of wind, waves and water currents. Thus, the buoy constitutes a submerged rotating body ("submerged turret"), which has resulted in the above-mentioned designation of the utilized technique.

The STL technique has turned out to have very substantial advantages in practice, both connection and disconnection between vessel and buoy being able to be carried out in a simple and quick manner, even in bad weather with relatively high waves. Further, the buoy may remain connected to the vessel in all weathers, a quick disconnection being able to be carried out if a weather limitation should be exceeded.

As will be appreciated, the use of the STL technique hitherto has been dependent on specially constructed tankers, the STL buoy presupposing a vessel which is provided with a submerged receiving space and the necessary installations for hoisting and introduction of the buoy into the receiving space, for releasable securement of the buoy and for connection of the central passage of the buoy to a pipe system which is arranged on the vessel and communicates with the storage tanks thereof.

It would, however, be desirable to be able to use the STL technique also in connection with tankers which do not have the necessary equipment or are built for the STL buoy, as this will give practical as well as economical advantages, especially with use in smooth and relatively shallow waters.

SUMMARY OF THE INVENTION

It is therefore an object of the invention to provide a loading/unloading terminal which is suitable for the above-mentioned use.

For the achievement of the above-mentioned object there is provided a loading/unloading terminal of the introductorily stated type which, according to the invention, is characterized in that it comprises a barge provided with a downwardly open receiving space for reception and releasable securement of a submerged buoy, and a submerged buoy of the type comprising a bottom-anchored centre member having a passage for transfer of a flowable medium from or to a transfer line attached to the centre member, and an outer member rotatably mounted on the centre member to allow turning of the barge about the centre member when the outer member is secured in the receiving space of the barge, the barge further being provided with a coupling means for connection of the passage of the centre member to a line for medium transfer to or from an adjacent vessel, and with a means for hoisting and introduction of the buoy into the receiving space.

BRIEF DESCRIPTION OF THE DRAWINGS

The invention will be further described below in connection with exemplary embodiments with reference to the drawings, wherein.

DETAILED DESCRIPTION OF THE PREFERRED EMBODIMENTS

Figure 1:
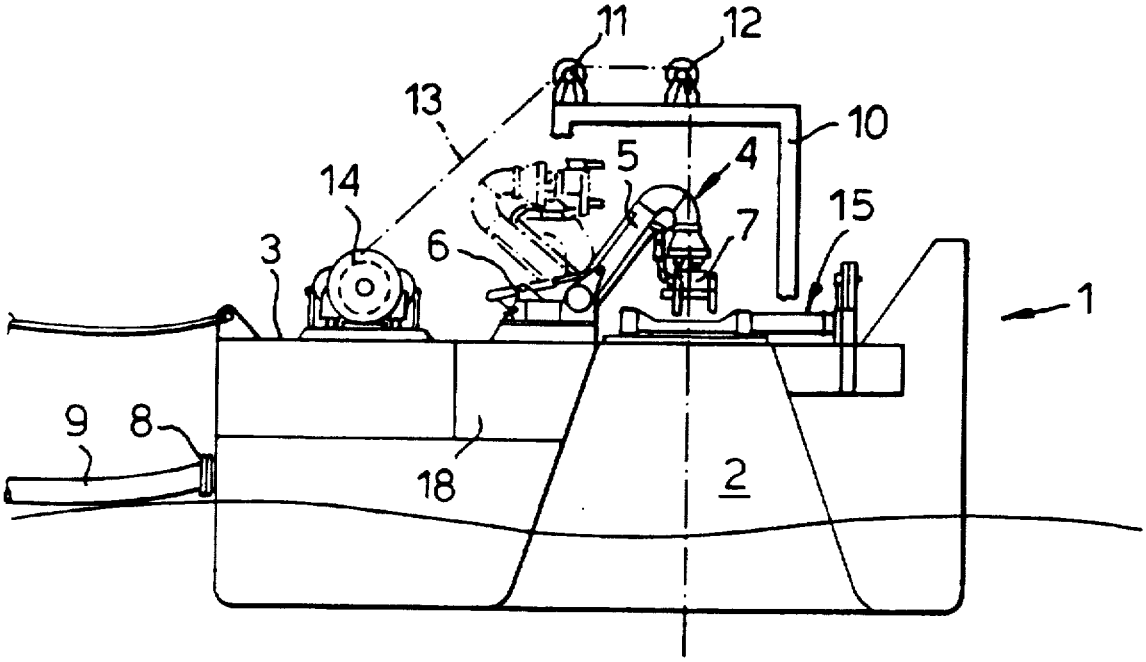
FIG. 1 shows a schematic sectioned side view of a first embodiment of a barge in a loading/unloading terminal according to the invention.
Figure 2:
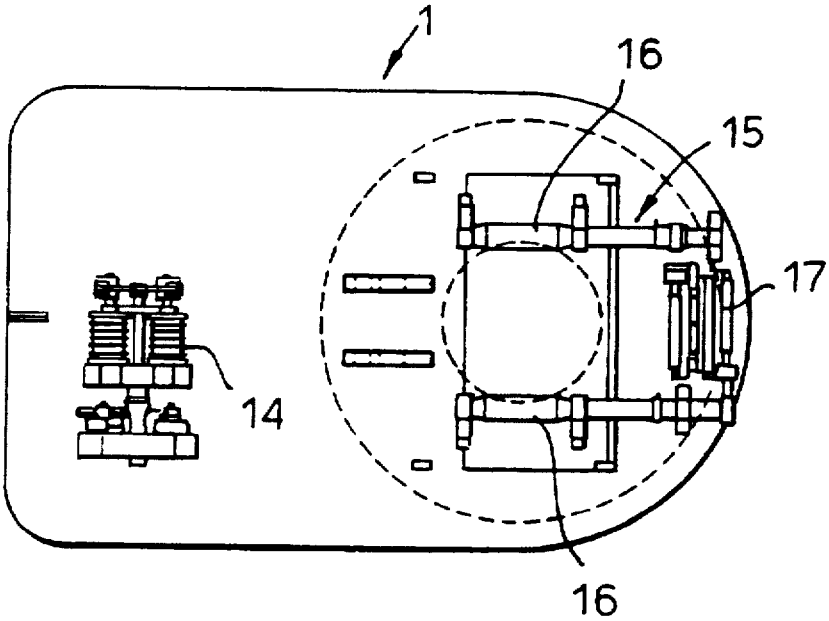
FIG. 2 shows a somewhat incomplete plan view of the embodiment in FIG. 1.

The barge shown in FIGS. 1 and 2, which forms part of a loading/unloading terminal according to the invention, is provided with a downwardly open receiving space 2 extending through the whole barge hull, up to the deck 3 of the barge. The receiving space is upwardly tapering and adapted for reception of a correspondingly shaped buoy which is of the introductorily stated STL type and which may be constructed such as further described in connection with FIG. 3.

Figure 4:
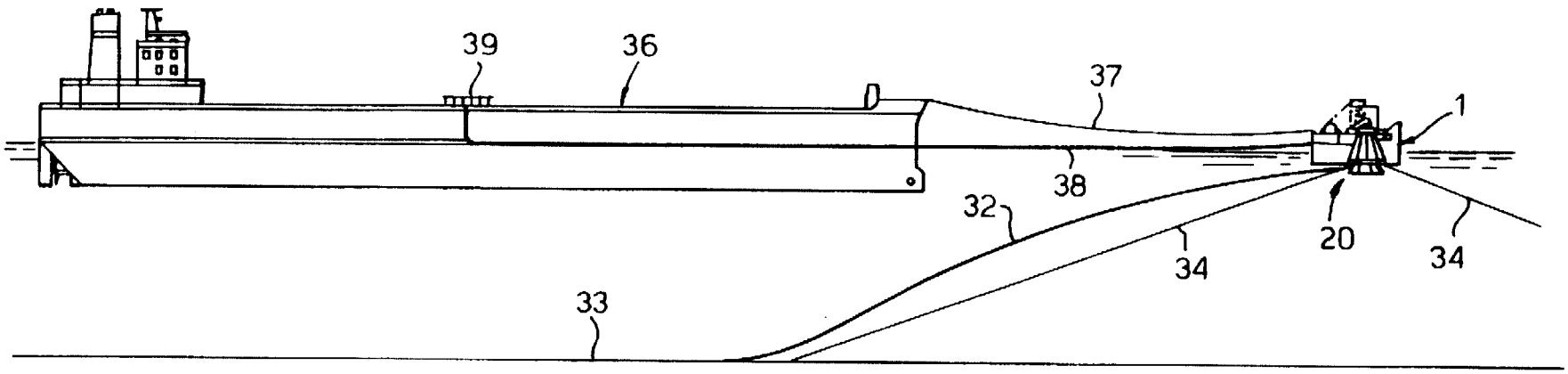
FIG. 4 shows a side view of a loading/unloading terminal according to the invention, having a buoy according to FIG. 3 introduced into the receiving space of the barge, and wherein the barge is coupled to a vessel at a distance therefrom.
Figure 5:
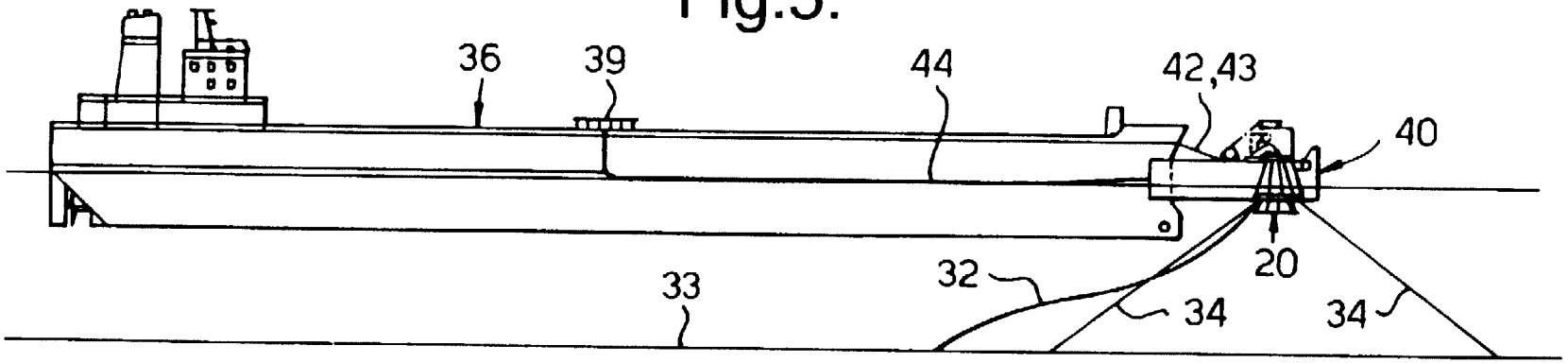
FIG. 5 shows a view corresponding to that of FIG. 4, but of another embodiment of the barge designed for direct connection to a vessel, in abutment against the bow portion thereof.

At the deck 3 of the barge there is arranged a coupling unit 4 for connection of the passage through the centre member of the buoy to a line for transfer of medium to or from a conventional tanker, as shown in FIGS. 4 and 5. This unit comprises a curved coupling tube 5 (a so-called "gooseneck") which, by means of a hydraulic cylinder 6, is pivotable between a stowed position and a connecting position (both positions shown in FIG. 1). The free end of the tube is provided with a coupling head 7 for connection to the upper end of the centre member of the buoy when the buoy is in place in the receiving space. The coupling tube communicates with a conduit (not shown) which is arranged within the barge hull and is connected to a coupling flange 8 for connection of a hose 9 for medium transfer to/from the topical vessel.

On the barge deck there is further provided a guide frame 10 having guide rollers 11, 12 for guiding of a line 13 for hoisting and introduction of the topical buoy into the receiving space 2. The line is operated by a winch means 14. Instead of a winch it is also conceivable to use a suitable jack means. On the deck there is further provided a locking means 15 for releasable securement of the topical buoy in the receiving space. In the illustrated embodiment, this means consists of rotatable locking elements 16 which are arranged to grip under a locking collar on the buoy, and which are operated by means of a suitable hydraulic drive means 17. A hydraulic power supply unit 18 for operation of the hydraulic units on the barge is suggested to be arranged below the deck of the barge.

The above-mentioned equipment is of a known design, and for further description of such equipment on a STL ship reference may be made to Norwegian laying-open print No. 175 420.

Figure 3:
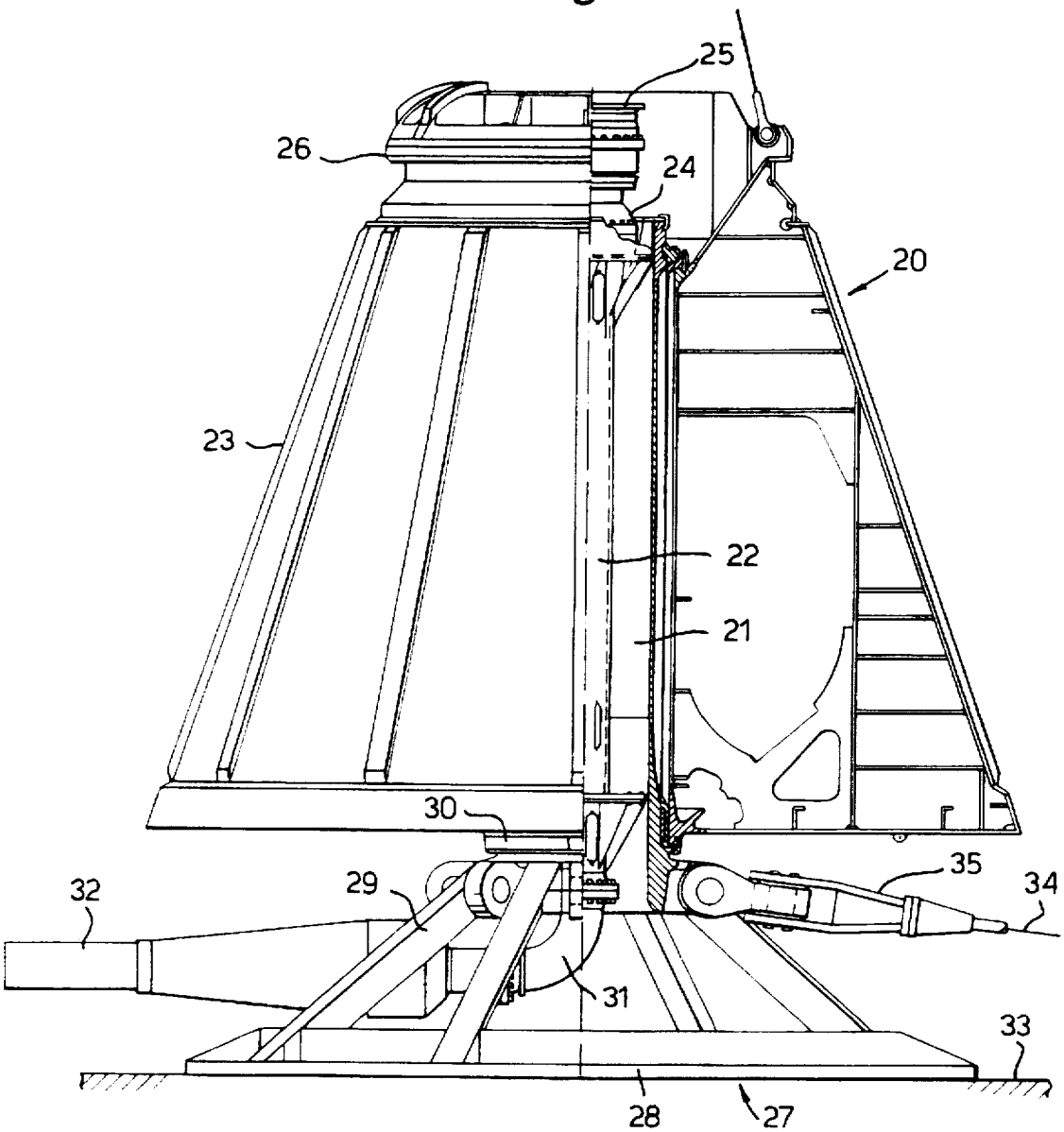
FIG. 3 shows a partly sectioned side view of a STL buoy which is provided with a bottom support means for resting on the sea bed when it is not in use.

The buoy shown in FIGS. 3–5 is especially constructed for use in shallow waters, and the buoy is provided with a bottom support means to be placed at the sea bed when it is not in use. Such a buoy structure is the subject of the simultaneously filed patent application No. 944211, and reference is here made to this application for a further description of the buoy construction. Reference is also made to U.S. Pat. No. 5,509,838 wherein a STL buoy of the topical type is further shown and described, and to U.S. Pat. No. 5,529,521 showing different embodiments of locking means which may also be used on the barge 1. Instead of such rotatable locking means it is also conceivable to use horizontally movable locking means, for example segment wedges.

The buoy 20 shown in FIG. 3 comprises a central member or centre member 21 in the form of a hollow shaft having a passage 22 for the flowable medium which is to be transferred via the buoy, and an outer member 23 which is rotatably mounted on the centre member 21 and arranged to be secured in the receiving space 2 of the barge. The centre member 21 at its upper end is provided with a swivel unit 24 and a valve unit 25 for connection to the coupling head 7 on the above-mentioned coupling unit 4. The outer member 23 has a cone shape which is adapted to the receiving space 2, and the upper part as shown has a locking collar 26 for engagement with the locking elements 16 in the locking means 15 arranged on the barge.

As shown, the bottom support structure 27 of the buoy consists of a ring-shaped or annular support body 28 which, through a number of braces 29, is attached to a reinforced holding portion 30 of the centre member 21 of the buoy. The lower end of the passage 22 of the centre member is connected through a 90° bend 31 to a transfer line in the form of a flexible riser 32 which is shown to extend horizontally outwards from the buoy structure.

The buoy is anchored to the sea bed 33 by means of a number (e.g. eight) of mooring lines 34 which are connected to the centre member 21 of the buoy through respective coupling links 35 which suitably may be universal joints, as appears from FIG. 3. The mooring lines 34 are relatively long, to utilize the elasticity of the lines when the buoy is hoisted up and introduced into the receiving space of the barge, as further described in the above-mentioned simultaneously filed patent application.

FIG. 4 shows an embodiment wherein the barge 1 is coupled to a conventional tanker 36 which is located at a distance from the barge. The barge is moored to the vessel by means of a mooring hawser 37, and a loading hose 38—corresponding to the loading hose 9 in FIG. 1—extends between the barge and the midship manifold 39 of the vessel. As shown, a part of the loading hose may float in the sea.

Figure 6:
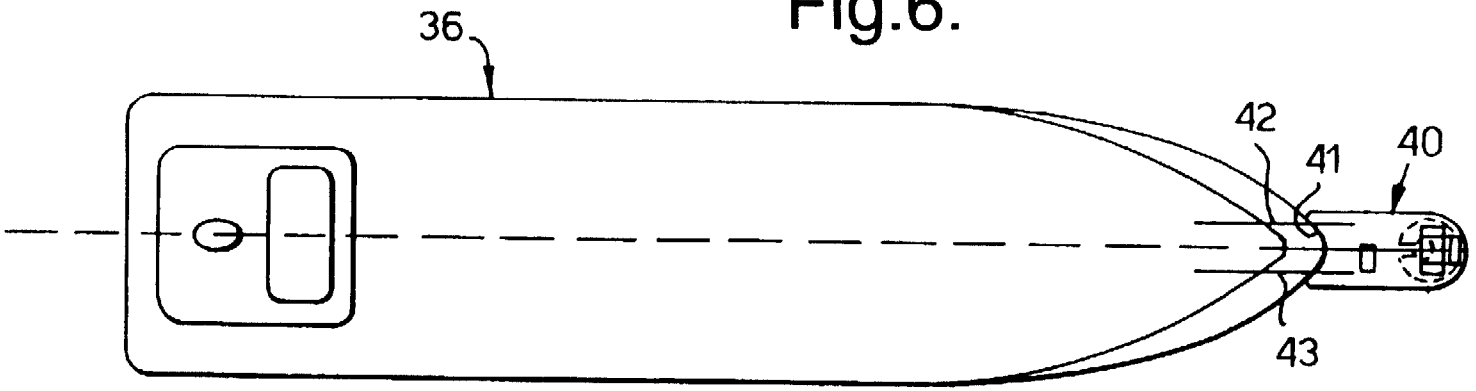
FIG. 6 shows a plan view of the embodiment in FIG. 5.

FIGS. 5 and 6 show another embodiment wherein the barge 40 is designed for direct connection to the tanker 36, in abutment against the bow portion thereof, so that the vessel and barge form a unit. The end portion of the barge remote from the receiving space here is formed with a recess 41 which is essentially complementary to the shape of the bow portion of the vessel 36. The barge can be pulled up to the vessel by means of the vessel's own winches (not shown), suitable fastening points for the winch lines being provided on the barge. In the illustrated case the barge is shown to be kept in position in contact with the bow of the vessel by means of a pair of lines 42 and 43. A loading hose 44 extends between the barge and the vessel and is also here coupled to the midship manifold 39 of the vessel.

In the recess 41 of the barge there are advantageously mounted fender means (not shown) for abutment against the bow portion of the vessel. Advantageously, these may consist of inflatable rubber fenders. It is also conceivable to use fenders mounted on e.g. hydraulic arms, for adaptation to different hull or bow shapes.

By means of the illustrated embodiments the STL technology may be used in connection with conventional tankers. In relation to the embodiment in FIG. 4, the embodiment according to FIG. 5 among other things has the advantage that one avoids the possible use of a tugboat to prevent the barge from moving towards and impacting with the tanker.

The invention has been shown and described above in connection with a buoy which is placed at the sea bed when it is not in use. It will be clear, however, that the loading/unloading terminal according to the invention may also be used in loading and unloading at larger water depths, i.e. in connection with a STL buoy of the type floating in a submerged condition when it is not in use.

I claim:

1. A loading/unloading terminal for loading or unloading petroleum products between a tanker and a submerged buoy, said terminal comprising:

a) a barge (1; 40) provided with a downwardly open receiving space (2) for the reception and releasable securement of a submerged buoy, b) a submerged buoy (20) comprising a bottom-anchored centre member (21) having a passage (22) for the transfer of petroleum products from or to a transfer line (32) attached to the centre member, and an outer member (23) rotatably mounted on the centre member to allow turning of the barge about the centre member when the outer member is secured in the receiving space of the barge, c) coupling means (4) provided on the barge for connecting the passage of the centre member of the buoy to a line (9; 38; 44) for transferring petroleum products to or from an adjacent tanker (36) connected to the barge, and d) means (10–14) provided on the barge for hoisting and introducing the buoy into the receiving space.

2. A loading/unloading terminal according to claim 1, provided with a mooring hawser (37) and a loading hose (38) for, respectively, mooring of and petroleum products transfer to/from a tanker located at a distance from the barge.

3. A loading/unloading terminal according to claim 1, wherein the barge has a hull portion formed with a recess (41) having a shape complementary to the shape of the bow portion of the tanker, means (42, 43) being provided for interconnecting the barge and the tanker as a unit.

4. A loading/unloading terminal according to claim 3, comprising fender means provided in said recess for abutment against the bow portion of the tanker.

5. A loading/unloading terminal according to claim 4, wherein the fender means are inflatable rubber fenders.

6. A loading/unloading terminal according to claim 1, wherein the receiving space extends through the hull of the barge, and both the coupling means and the hoisting means are arranged on the deck of the barge.

7. A loading/unloading terminal according to claim 1, wherein the buoy has a bottom support structure (27) connected to the centre member of the buoy for supporting the buoy on the sea bed (33) when it is not in use.

* * * * *